US011957248B2

(12) United States Patent
Freelend et al.

(10) Patent No.: US 11,957,248 B2
(45) Date of Patent: Apr. 16, 2024

(54) ADJUSTABLE BED BASE WITH SUBFRAME FOR LIFT AND TILT

(71) Applicant: L&P Property Management Company, South Gate, CA (US)

(72) Inventors: Isaac T. Freelend, Sarcoxie, MO (US); Joseph P. Sanford, Granby, MO (US); Dustin W. Smith, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 240 days.

(21) Appl. No.: 17/713,463

(22) Filed: Apr. 5, 2022

(65) Prior Publication Data

US 2023/0309703 A1 Oct. 5, 2023

(51) Int. Cl.
*A47C 20/04* (2006.01)

(52) U.S. Cl.
CPC ..... *A47C 20/041* (2013.01)

(58) Field of Classification Search
CPC ..... A47C 20/041; A47C 19/045
USPC ..... 5/618
See application file for complete search history.

(56) References Cited

U.S. PATENT DOCUMENTS 1,367,621 A * 2/1921 Meves ..... A47C 17/225 5/12.2
5,271,109 A * 12/1993 Markel ..... A47C 17/1756 5/47
5,577,280 A * 11/1996 Elliott ..... A61G 7/00 5/617
6,249,926 B1 * 6/2001 Wulff ..... A47L 11/4077 15/320
6,289,536 B1 * 9/2001 Betson ..... A61G 7/1017 5/624
7,458,119 B2 * 12/2008 Hornbach ..... A61G 7/002 5/624
8,960,971 B1 * 2/2015 Newton ..... F21S 8/036 362/371
9,032,569 B2 * 5/2015 Xu ..... A47C 20/08 5/616
9,049,942 B2 * 6/2015 Huang ..... A61G 7/018
9,125,776 B1 * 9/2015 Shih ..... A61G 7/018
9,918,556 B2 * 3/2018 Rawls-Meehan .... A47C 27/082
9,944,208 B2 * 4/2018 Cheng ..... A61G 5/128
2006/0053555 A1 * 3/2006 Poulos ..... A61G 7/0514 5/618
2006/0059624 A1 * 3/2006 Poulos ..... A61G 7/002 5/618
2007/0000056 A1 * 1/2007 Ward ..... A61G 1/04 5/618
2007/0000059 A1 * 1/2007 Brown ..... A61G 7/053 5/618

(Continued)

*Primary Examiner* — Justin C Mikowski
*Assistant Examiner* — Luke Hall
(74) *Attorney, Agent, or Firm* — Wood Herron & Evans LLP

(57) ABSTRACT

An adjustable bed base has a subframe which may be raised and lowered relative to a stationary frame by primary linear actuators. A deck is attached to the subframe. The deck may be flat or fully articulated depending upon the position of secondary linear actuators which are a part of a subframe module. The subframe module may be secured to the stationary frame of the adjustable bed base. The deck may be inclined by extending one of the primary linear actuators more than the other regardless of the positions of the deck members.

20 Claims, 13 Drawing Sheets

(56) References Cited

U.S. PATENT DOCUMENTS

2007/0083993 A1* 4/2007 Lindner ..... A47C 19/045 5/611
2007/0157385 A1* 7/2007 Lemire ..... A61G 7/0524 5/618
2007/0163046 A1* 7/2007 Eriksson ..... A47C 20/041 5/618
2008/0276373 A1* 11/2008 Clenet ..... A47C 21/026 5/618
2008/0289101 A1* 11/2008 Patterson ..... A61G 7/1032 5/81.1 HS
2009/0140114 A1* 6/2009 Blackburn ..... A47B 21/0314 248/282.1
2010/0007180 A1* 1/2010 Ovre ..... A61G 5/127 297/354.1
2011/0094032 A1* 4/2011 Shih ..... A47C 20/041 5/616
2012/0096645 A1* 4/2012 Shih ..... A47C 20/041 5/616
2012/0240337 A1* 9/2012 Shih ..... A61G 7/015 5/616
2014/0093861 A1* 4/2014 Scolari ..... G09B 9/04 434/373
2014/0189954 A1* 7/2014 Lee ..... A61G 7/005 5/618
2014/0250600 A1* 9/2014 McCarty ..... A47C 20/041 5/617
2014/0325759 A1* 11/2014 Bly ..... A61G 7/015 5/613
2014/0352068 A1* 12/2014 Xu ..... A61G 7/015 5/616
2015/0107024 A1* 4/2015 Xu ..... A47C 20/041 5/616
2016/0051057 A1* 2/2016 Murphy ..... A47C 17/2073 5/29
2016/0331609 A1* 11/2016 Cheng ..... A61G 5/128
2017/0087039 A1* 3/2017 Shih ..... A61G 7/018
2018/0338625 A1* 11/2018 Nava ..... A47C 19/021
2019/0000238 A1* 1/2019 Eskridge, III ..... A61G 7/07
2019/0021511 A1* 1/2019 Shih ..... A47C 20/041
2019/0125089 A1* 5/2019 Aramli ..... A47C 19/021
2020/0397147 A1* 12/2020 Ren ..... A47C 19/021
2021/0052085 A1* 2/2021 Wang ..... A47C 31/005
2021/0169720 A1* 6/2021 Diaz-Hellin Nicolas ..... A61G 7/012
2021/0259432 A1* 8/2021 Wang ..... A47C 20/12
2021/0321785 A1* 10/2021 Wang ..... A47C 21/00
2022/0248862 A1* 8/2022 Liu ..... A47C 19/024

* cited by examiner

ADJUSTABLE BED BASE WITH SUBFRAME FOR LIFT AND TILT

FIELD OF THE INVENTION

This invention relates generally to bedding products and, more particularly, to an adjustable bed base having a subframe which may be lifted and tilted.

BACKGROUND OF THE INVENTION

Conventional adjustable bed bases often have a stationary frame supported by leg assemblies. Such adjustable bed bases typically include a deck supported by the stationary frame. The deck supports a mattress. The deck usually comprises multiple deck members hinged together. One of the deck members is commonly fixedly secured to the stationary frame. A head deck member is typically hinged to the seat deck member. A first motorized linear actuator inclines the front end of the head deck member so a user may sit up and read or watch television in an inclined position.

A leg deck member is commonly hinged to the seat deck member and a foot deck member hinged to the leg deck member. A second motorized linear actuator serves to incline the leg and foot deck members around a person's knees for comfort.

One drawback to such common adjustable bed bases is that the frame is not able to move vertically. Therefore, tall or short persons may have difficulty entering and/or exiting an adjustable bed supported by known adjustable bed bases. Alternatively, persons with disabilities may have difficulty entering and/or exiting an adjustable bed supported by known adjustable bed bases.

Another drawback to known adjustable bed bases is that the articulated deck is always horizontal when the deck members are aligned or flat. There is no mechanism to either incline or decline the articulated deck when the deck members are all flat and aligned. Persons with health issues such as circulation issues or gastroesophageal reflux disease ("GERD") issues may desire a flat platform which is inclined such that the head end is above the foot end of the platform. Alternatively, their health conditions may require that the flat platform be inclined such that the head end of the platform is below the foot end of the deck platform.

In view of the above, there is a need for an adjustable bed base having a vertically adjustable frame. There is further a need for an adjustable bed base which is capable of inclining or declining the articulated deck of the adjustable bed base when the articulated deck is flat or planar.

It is therefore an objective of this invention to provide an adjustable bed base having a frame which may be adjusted vertically.

It is further an objective of this invention to provide an adjustable bed base having an articulated deck which may be inclined or declined when flat.

SUMMARY OF THE INVENTION

According to one aspect of the invention, an adjustable bed base comprises a generally rectangular stationary frame having opposed side rails, a head rail, a foot rail and a middle rail. Each of the side rails have a C-shaped cross-section defining a channel. Legs which may or may not be adjustable in height are secured to the stationary frame for supporting the stationary frame.

The adjustable bed base further comprises a subframe secured to the stationary frame which is movable relative to the stationary frame. The subframe comprises opposed side members, a head member, a foot member and a cross member extending between the opposed side members. Front and rear lift arms are pivotally secured to the side members of the subframe. Two front lift arms are connected by a front push member. Two rear lift arms are connected by a rear push member. Rotatable wheels are secured to lower ends of the front and rear push members. The rotatable wheels are sized and adapted to move inside the channels of the side rails of the stationary frame. Rear lift arm supports limit movement of the rear lift arms. The rear lift arm supports are pivotally secured to the rear lift arms and pivotally secured to corner brackets secured to the stationary frame.

The adjustable bed base further comprises an articulated deck comprising a head deck board, a seat deck board, a leg deck board and a foot deck board hinged together. The seat deck board is secured to the stationary frame and remains stationary regardless of the positions of the other deck boards. The boards may be made of wood, plastic or any known material. A head brace is secured to the head deck board and a leg brace is secured to the leg deck board. In one embodiment, the head and leg braces are generally U-shaped comprising three metal members. Each brace provides an anchor for the secondary linear actuators and functions to strengthen the respective board member to which it is attached.

The adjustable bed base further comprises front and rear primary linear actuators. The front primary linear actuator functions to raise and lower a front portion of the subframe to tilt the deck. The rear primary linear actuator functions to raise and lower a rear portion of the subframe to tilt the deck the other direction.

The front primary linear actuator has a first end pivotally secured to a first mounting bracket. The first mounting bracket is secured to the middle rail of the stationary frame. The front primary linear actuator has a second end pivotally secured to a mounting bracket secured to the front push member.

The rear primary linear actuator has a first end pivotally secured to a second mounting bracket secured to the middle rail of the stationary frame. The rear primary linear actuator has a second end pivotally secured to a mounting bracket secured to the rear push member.

The adjustable bed base further comprises front and rear secondary linear actuators. A front secondary linear actuator functions to incline the head deck board. The front secondary linear actuator has a first end pivotally secured to a mounting bracket secured to the cross rail of the stationary frame. The second end of the front secondary linear actuator is pivotally secured to the front brace.

A rear secondary linear actuator functions to incline the leg and foot deck boards. The rear secondary linear actuator has a first end pivotally secured to a mounting bracket secured to the rear member of the subframe. The rear secondary linear actuator has a second end pivotally secured to the leg brace.

The four linear actuators are preferably motorized. The deck, whether articulated or flat, is tilted when one of the primary linear actuators is extended more than the other primary linear actuator. The maximum tilt occurs when one of the primary linear actuators is fully extended and other of the primary linear actuators is full withdrawn or contracted. These primary linear actuators function to tilt the subframe regardless of whether the deck members are fully inclined or flat or any position therebetween.

Worded another way, the adjustable bed base comprises a stationary frame supported by legs, a subframe, an articulated deck and head and leg braces, as described above. The adjustable bed base further comprises a front pusher assembly comprising front lift arms and a front push member extending between the front lift arms. Each of the front lift arms is pivotally secured to one of the side members of the subframe. The adjustable bed base further comprises a rear pusher assembly comprising rear lift arms and a rear push member extending between the rear lift arms. Each of the rear lift arms is pivotally secured to one of the side members of the subframe. Rotatable wheels are secured to lower ends of the front and rear lift arms. The rotatable wheels are movable inside the channels of the side rails of the stationary frame. Lift arm supports limit movement of one of the front and rear lift arms. Each of the lift arm supports is pivotally secured to one of the lift arms and pivotally secured to a corner bracket secured to the stationary frame.

The adjustable bed base further comprises a front primary linear actuator for moving the front pusher assembly, thereby raising and lowering a front portion of the subframe. The front primary linear actuator has a first end pivotally secured to a first mounting bracket secured to the middle rail of the stationary frame and a second end pivotally secured to a mounting bracket secured to the front pusher assembly. The front pusher assembly is moved forwardly when the front primary linear actuator is extended, thereby raising a front portion of the subframe. Conversely, the front pusher assembly is moved rearwardly when the front primary linear actuator is contracted, thereby lowering the front portion of the subframe.

The adjustable bed base also has a rear primary linear actuator for moving the rear pusher assembly, thereby raising and lowering a rear portion of the subframe. The rear primary linear actuator has a first end pivotally secured to a second mounting bracket secured to the middle rail of the stationary frame and a second end secured to a mounting bracket secured to the rear pusher assembly. The rear pusher assembly is moved rearwardly when the rear primary linear actuator is extended, thereby raising a rear portion of the subframe. Conversely, the rear pusher assembly is moved forwardly when the rear primary linear actuator is contracted, thereby lowering the rear portion of the subframe.

The further the front and rear push members are separated, the higher the subframe and articulated deck. The subframe is raised above the stationary frame when the primary linear actuators are extended. The subframe and articulated deck are tilted when one of the primary linear actuators is extended more than the other primary linear actuator.

The adjustable bed base further comprises a front secondary linear actuator for inclining the head deck board. The front secondary linear actuator has a first end pivotally secured to a mounting bracket secured to the cross member of the subframe and a second end pivotally secured to the head brace. The adjustable bed base further comprises a rear secondary linear actuator for moving the leg and foot deck boards. The rear secondary linear actuator has a first end pivotally secured to a mounting bracket secured to the rear member of the subframe and a second end pivotally secured to the leg brace. The linear actuators are typically motorized and remotely controlled. However, non-motorized linear actuators may be controlled in any known manner.

The accompanying drawings, which are incorporated in and constitute a part of this specification, illustrate embodiments of the invention and, together with the summary of the invention given above, and the detailed description of the drawings given below, explain the principles of the present invention.

DETAILED DESCRIPTION OF THE INVENTION

Figure 1:
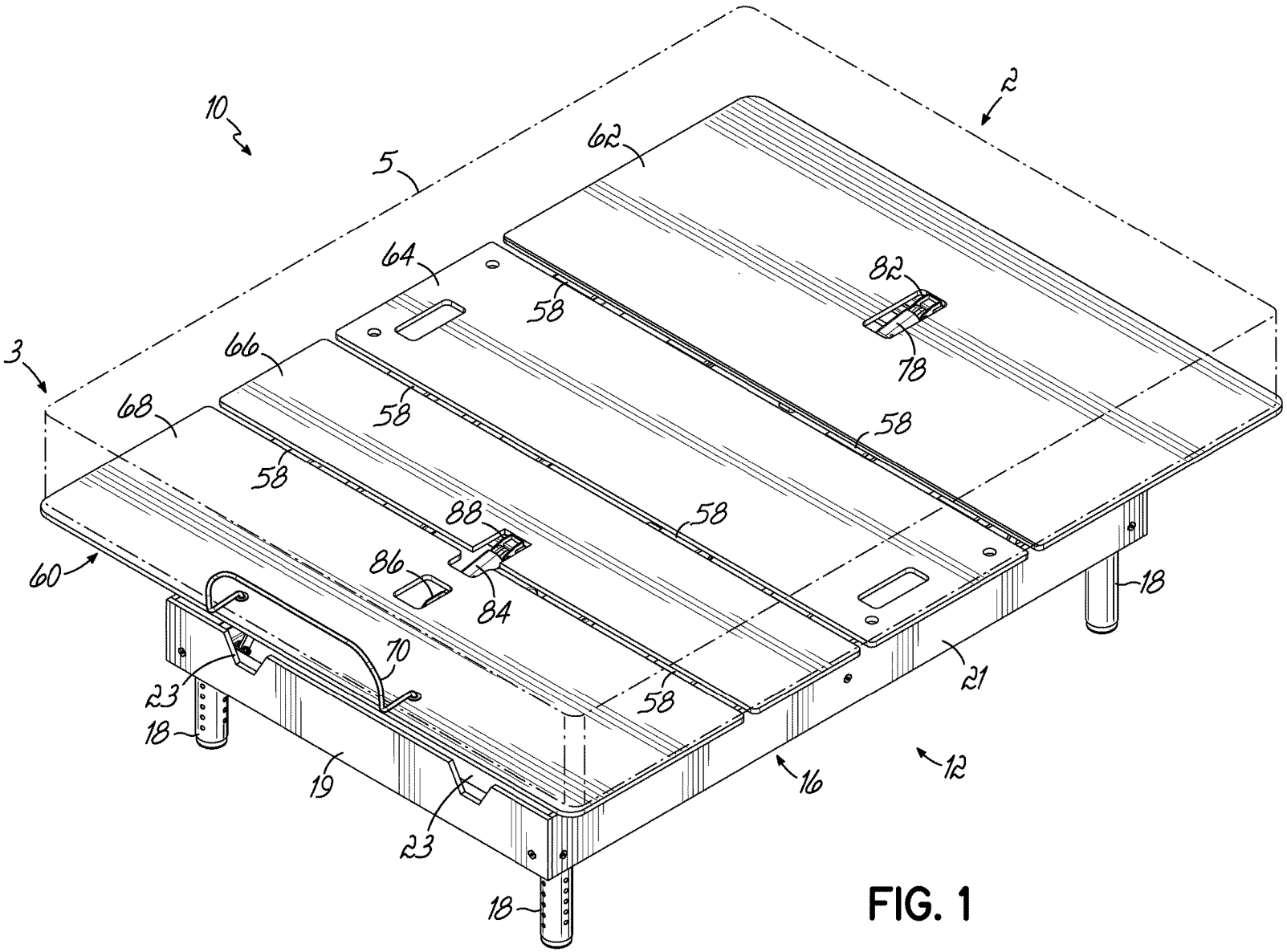
FIG. 1 is a top perspective view of an adjustable bed base.

Referring to FIG. 1, an adjustable bed 10 has a head end 2 and a foot end 3. The adjustable bed 10 includes an adjustable bed base 12 for supporting a mattress 5. The adjustable bed base 12 of the present invention may be used with any type of mattress. The mattress is not intended to be limited by the drawings.

Figure 2:
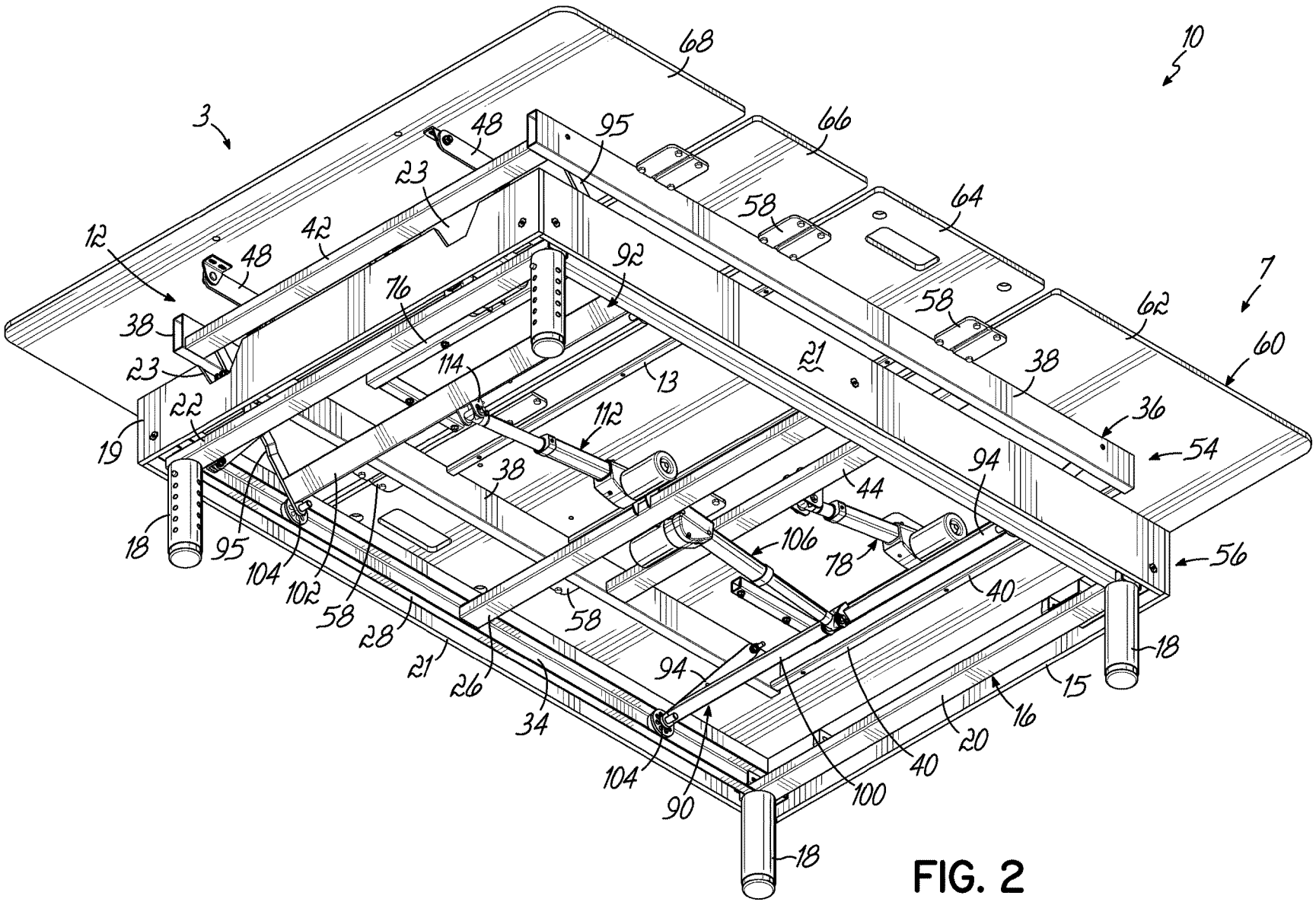
FIG. 2 is a bottom perspective view of the adjustable bed base of FIG. 1.

As best shown in FIG. 2, the adjustable bed base 12 comprises a generally rectangular stationary frame 16 supported by leg assemblies 18. The leg assemblies 18 are illustrated as being adjustable in height. Although one type of leg assembly 18 is illustrated supporting the adjustable bed base 12, any other type of leg assembly including unitary legs not adjustable in height may be used in in accordance with the present invention. The legs of the adjustable bed base are not intended to be limited by the drawings.

Figure 5:
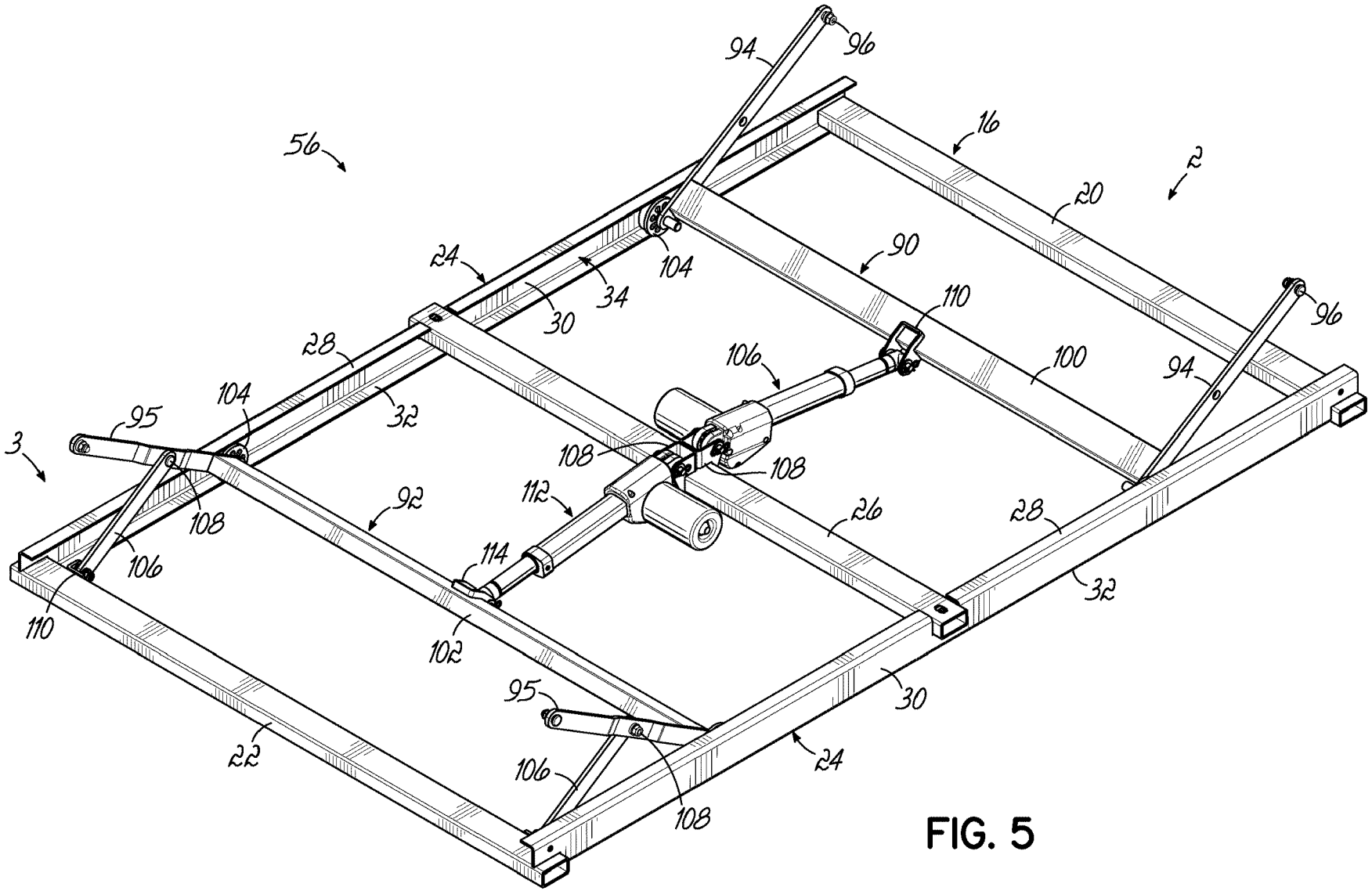
FIG. 5 is a perspective view of a portion of the frame assembly.

As best shown in FIG. 5, the generally rectangular stationary frame 16 comprises a head rail 20, a foot rail 22 and two opposed side rails 24, each side rail 24 extending between the head and foot rails 20, 22, respectively. As best shown in FIG. 2, the generally rectangular frame 16 further comprises a middle rail 26 extending between the opposed side rails 24. Although FIG. 5 shows the head rail 20, foot rail 22 and middle rail 26 each having a hollow interior, one or more of these rails may be a solid member. As best shown in FIG. 5, each of the side rails 24 has a C-shaped cross section comprising an upper wall 28, a side wall 30 and a bottom wall 32 which define a channel 34. As best shown in FIGS. 1 and 2, a head board 15 is secured to the head rail 20, a foot board 19 is secured to the foot rail 22 and side boards 21 are secured to the side rails 24. The boards 15, 19 and 21 protect the generally rectangular stationary frame 16 and the components therein. The boards 15, 19 and 21 may be made of wood, plastic or any other known material.

Figure 4:
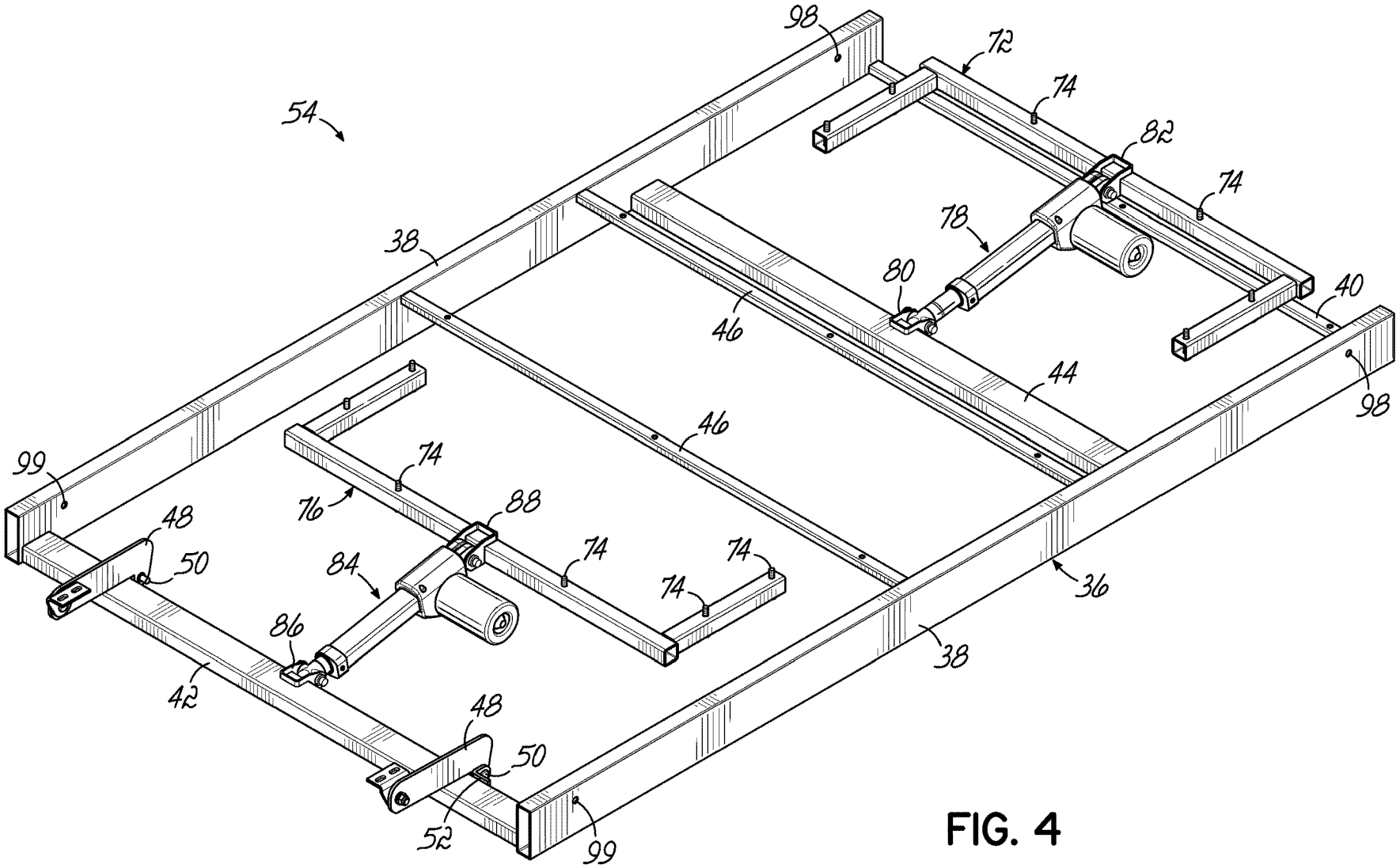
FIG. 4 is a perspective view of a portion of the subframe assembly.

As best shown in FIG. 4, the adjustable bed base 12 further comprises a subframe 36 comprising opposed side members 38, a head member 40, a foot member 42 and a cross member 44 extending between the opposed side members 38. Although FIG. 4 shows the opposed side members 38, head member 40, foot member 42 and cross member 44 each having a hollow interior, one or more of these members may be a solid member. As best shown in FIG. 4, the subframe 36 also includes two support members 46 for supporting a seat deck board 64 described below. Each of the support members 46 extends between the opposed side members 38.

Figure 3:
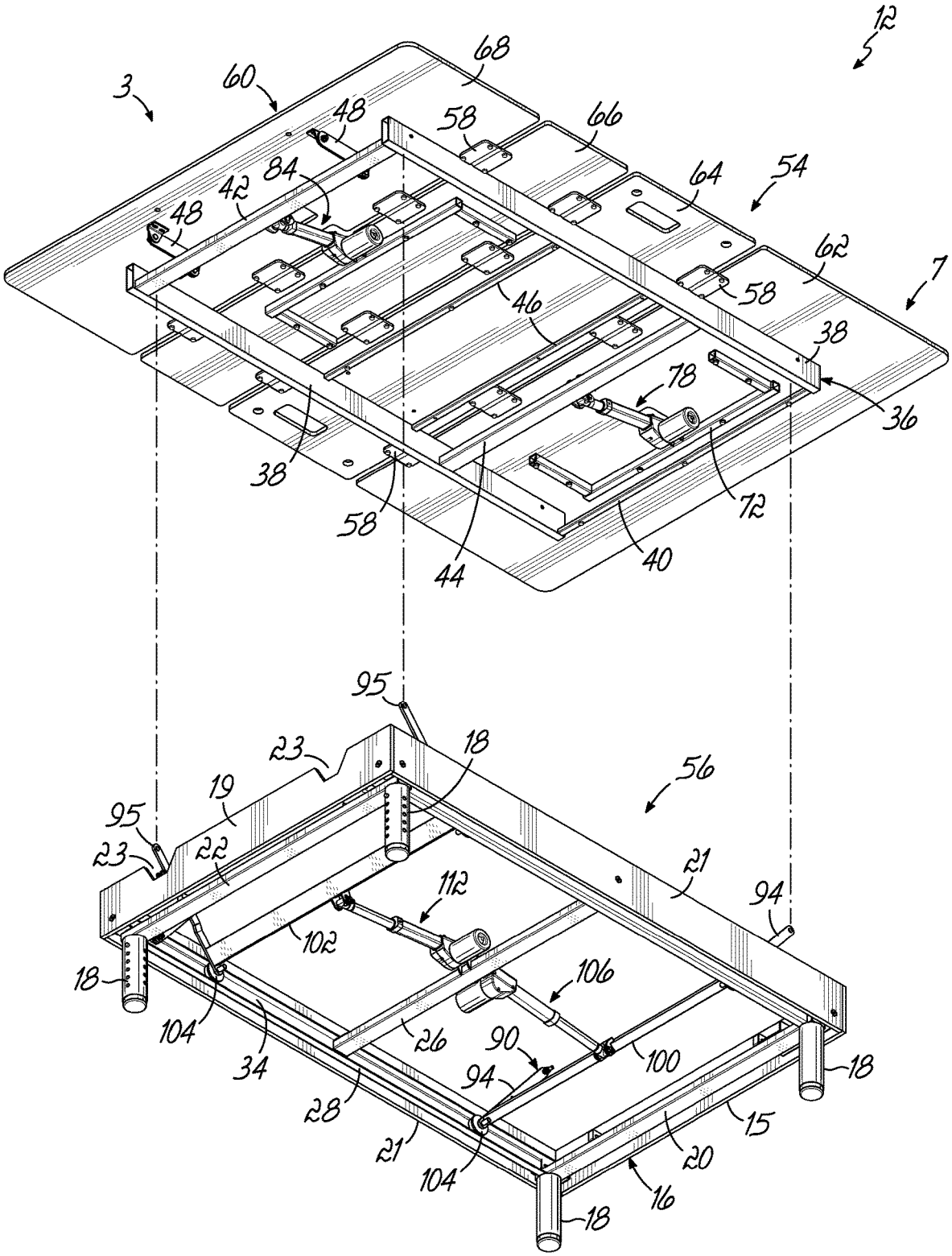
FIG. 3 is a bottom perspective view of a subframe assembly of the adjustable bed base separated from a frame assembly of the adjustable bed base.

As best shown in FIG. 4, the subframe 36 also includes two foot links 48 for attachment to the foot deck board 68 described below. As shown in FIG. 4, each of the foot links 48 is pivotal about a horizontal axis defined by a pivot pin 50, the pivot pin 50 extending through a mounting bracket 52 secured to the foot member 42 of the subframe 36. As best shown in FIG. 3, the foot board 19 has two cutouts 23 through which the foot links 48 extend during operation of the adjustable bed base 12.

As best shown in FIG. 3, the subframe 36 is part of a subframe assembly 54 for purposes of this document. Although not shown in FIG. 4, the deck 60 is part of the subframe assembly 54. The frame 16 and protective boards 15, 19 and 21 are part of a frame assembly 56 for purposes of this document. FIG. 4 shows an enlarged view of the subframe assembly 54 without the articulated deck. FIG. 5 shows an enlarged view of the frame assembly 56.

As best shown in FIGS. 1 and 2, the adjustable bed base 12 further comprises an articulating deck 60 comprising a head deck board 62 hinged to a seat deck board 64 with hinges 58. As best shown in FIGS. 2 and 3, the seat deck board 64 is secured to the support members 46 of the generally rectangular stationary frame 16 with fasteners 17 (see FIGS. 6A-6D) and does not move when the deck 60 is articulated. A leg deck board 66 is hinged to the seat deck board 64 with hinges 58. Lastly, a foot deck board 68 is hinged to the leg deck board 66 with hinges 58.

As best shown in FIG. 1, a stop 70 is secured to the foot deck board 68 of the deck 60 and functions to prevent movement of the mattress 5 relative to the adjustable bed base 12 when the deck 60 is articulated.

As best shown in FIGS. 3 and 4, the subframe assembly 54 of the adjustable bed base 12 further comprises a generally U-shaped head brace 72 secured to the underside of the head deck board 62 with fasteners 74. The subframe assembly 54 of the adjustable bed base 12 further comprises a generally U-shaped leg brace 76 secured to the underside of the leg deck board 66 with fasteners 74. As best shown in FIG. 4, although each of the head and leg braces 72, 76 respectively, is shown as comprising three pieces of hollow metal, either of the head and leg braces 72, 76 respectively, may be made of any number of pieces of any known material. The generally U-shaped head brace 72 functions to strengthen the head deck board 62 and provide an anchor for the linear actuator described below. Similarly, the generally U-shaped leg brace 76 functions to strengthen the leg deck board 66 and provide an anchor for the other linear actuator described below.

As best shown in FIG. 4, the subframe assembly 54 of the adjustable bed base 12 further comprises a motorized front secondary linear actuator 78 for inclining the head deck board 62. The motorized front secondary linear actuator 78 has a rear or first end pivotally secured to a mounting bracket 80 secured to the cross member 44 of the subframe 36. The motorized front secondary linear actuator 78 has a front or second end pivotally secured to a mounting bracket 82 secured to the generally U-shaped head brace 72.

As best shown in FIG. 4, the subframe assembly 54 of the adjustable bed base 12 further comprises a motorized rear secondary linear actuator 84 for inclining the leg deck board 66, which in turn inclines the foot deck board 68. The motorized rear secondary linear actuator 84 has a rear or first end pivotally secured to a mounting bracket 86 secured to the rear member 42 of the subframe 36. The motorized rear secondary linear actuator 84 has a front or second end pivotally secured to a mounting bracket 88 secured to the generally U-shaped leg brace 76.

Referring to FIG. 5, the frame assembly 56 includes the frame 16 described above. FIG. 5 shows a front pusher assembly 90 and a rear pusher assembly 92. The front pusher assembly 90 comprises front lift arms 94 pivotally secured to the side members 38 of subframe 36 by fasteners 96 extending through openings 98 in the side members 38 of subframe 36. The two front lift arms 94 are joined by a front push member 100 extending between the front lift arms 94. A rotatable wheel 104 is secured to a lower end of each front lift arm 94.

The rear pusher assembly 92 comprises rear arms 95 pivotally secured to the side members 38 of subframe 36 by fasteners 96 extending through openings 99 in the side members 38 of subframe 36. The two rear lift arms 95 are joined by a rear push member 102 extending between the rear lift arms 95. A rotatable wheel 104 is secured to a lower end of each rear lift arm 95. Each rotatable wheel 104 is sized and adapted to move inside one of the channels 34 of one of the side rails 24 of the frame 16. As best shown in FIG. 5, each rear lift arm 95 has a lift arm support 106 pivotally secured to one of the rear lift arm 95 at the top of the lift arm support 106 with a fastener 108. A lower end of each rear lift arm 95 is pivotally secured to a corner bracket 110. Each lift arm support 106 provides stability and strength to one of the rear lift arms 95. Although not shown, instead of supporting the rear lift arms 95, lift arm supports may alternatively support the front lift arms 94. However, lift arm supports may not be used on both the front and rear lift arms.

As best shown in FIG. 5, the frame assembly 56 further comprises a front motorized primary linear actuator 106 for raising and lowering a front portion 120 of the subframe 36. The front motorized primary linear actuator 106 has a rear end pivotally secured to a first mounting bracket 108. The first mounting bracket 108 is secured to the middle rail 26 of the stationary frame 16. The front motorized primary linear actuator 106 has a front end pivotally secured to a mounting bracket 110 secured to the front push member 100 of the front pusher assembly 90.

As best shown in FIG. 5, the frame assembly 56 further comprises a rear motorized primary linear actuator 112 for raising and lowering a rear portion of the articulated deck 60. The rear motorized primary linear actuator 112 has a front end pivotally secured to a second mounting bracket 108 secured to the middle rail 26 of the stationary frame 16. The rear motorized primary linear actuator 112 has a rear end pivotally secured to a mounting bracket 114 secured to the rear push member 102 of the rear pusher assembly 92.

Figure 6A:
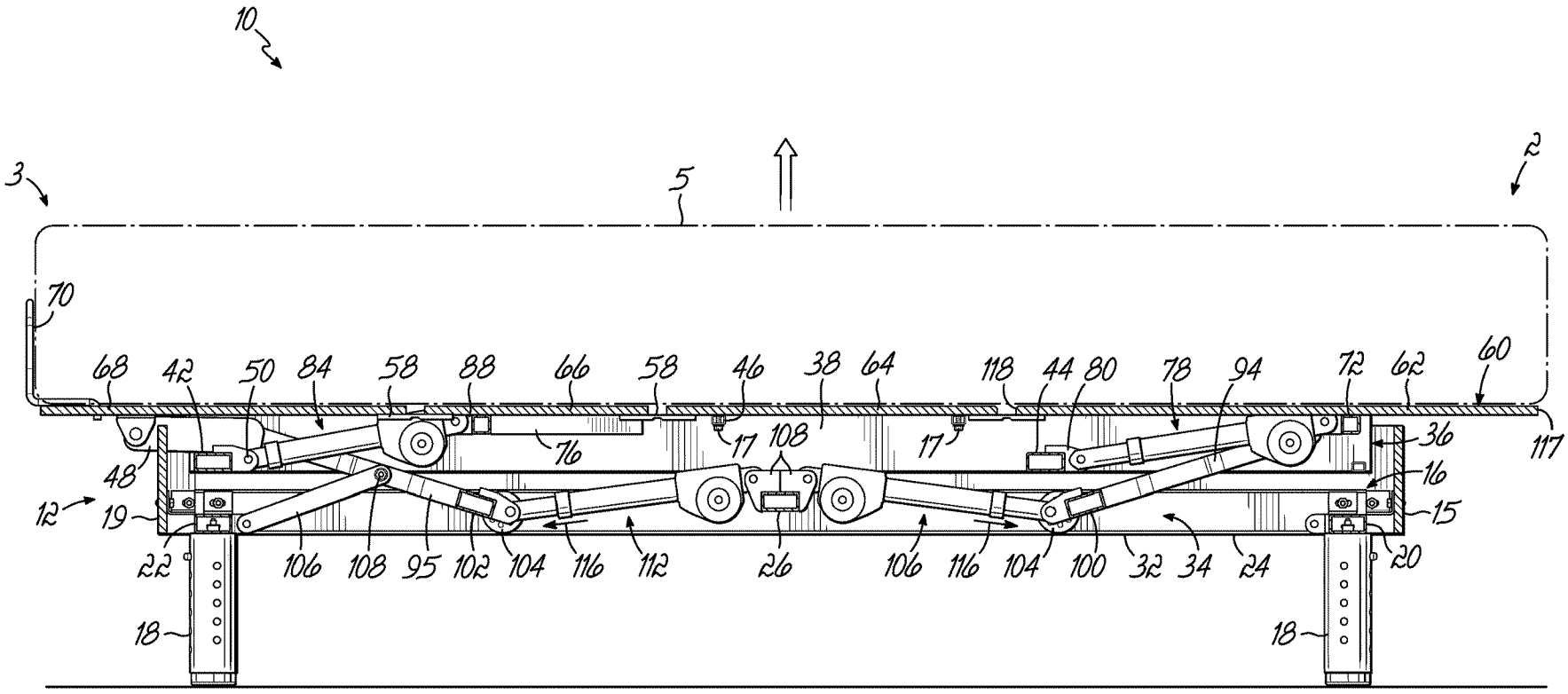
FIG. 6A is a longitudinal cross-sectional view of the adjustable bed base showing the subframe in a lowered position and the deck members co-planar.
Figure 6B:
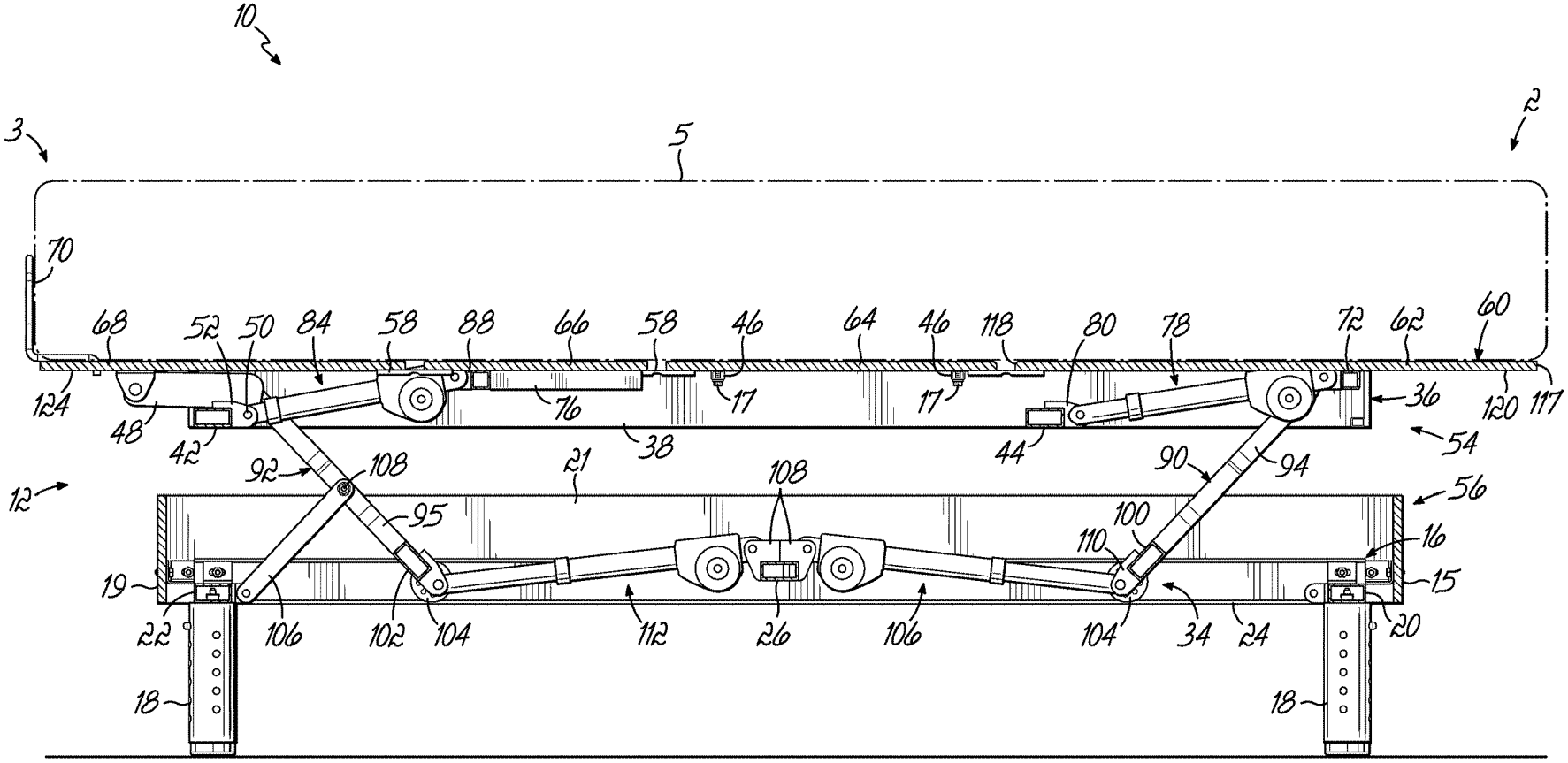
FIG. 6B is a longitudinal cross-sectional view of the adjustable bed base showing the subframe in a raised position and the deck members co-planar.

FIGS. 6A-6D show four different positions of the adjustable bed base 12, all with the deck 60 being flat or the deck members being co-planar. FIGS. 6A-6D also show a method of operation of the adjustable bed base 12. FIG. 6A shows the adjustable bed base 12 in a home position with the subframe 36 is its lowered position. In this home position, the front and rear primary lift actuators 106, 112, respectively, are fully retracted and not activated. From this home position shown in FIG. 6A, the primary linear actuators 106, 112 of adjustable bed base 12 are activated via remote control (not shown) to expand or lengthen. Such expansion of the primary linear actuators 106, 112 shown by arrows 116 in FIG. 6A, causes movement of the wheels 104 in channels 34 outwardly or away from each other. This movement of the wheels 104 causes the front pusher assembly 90 to move forwardly, thereby raising the front lift arms 94 to their fully inclined positions shown in FIG. 6B. This movement of the wheels 104 further causes the rear pusher assembly 92 to move rearwardly, thereby raising the rear lift arms 95 to their fully inclined positions shown in FIG. 6B. FIG. 6B shows the subframe and attached articulated deck 60 in a flat and fully raised position due to full extension of the front and rear primary lift actuators 106, 112, respectively.

Figure 6C:
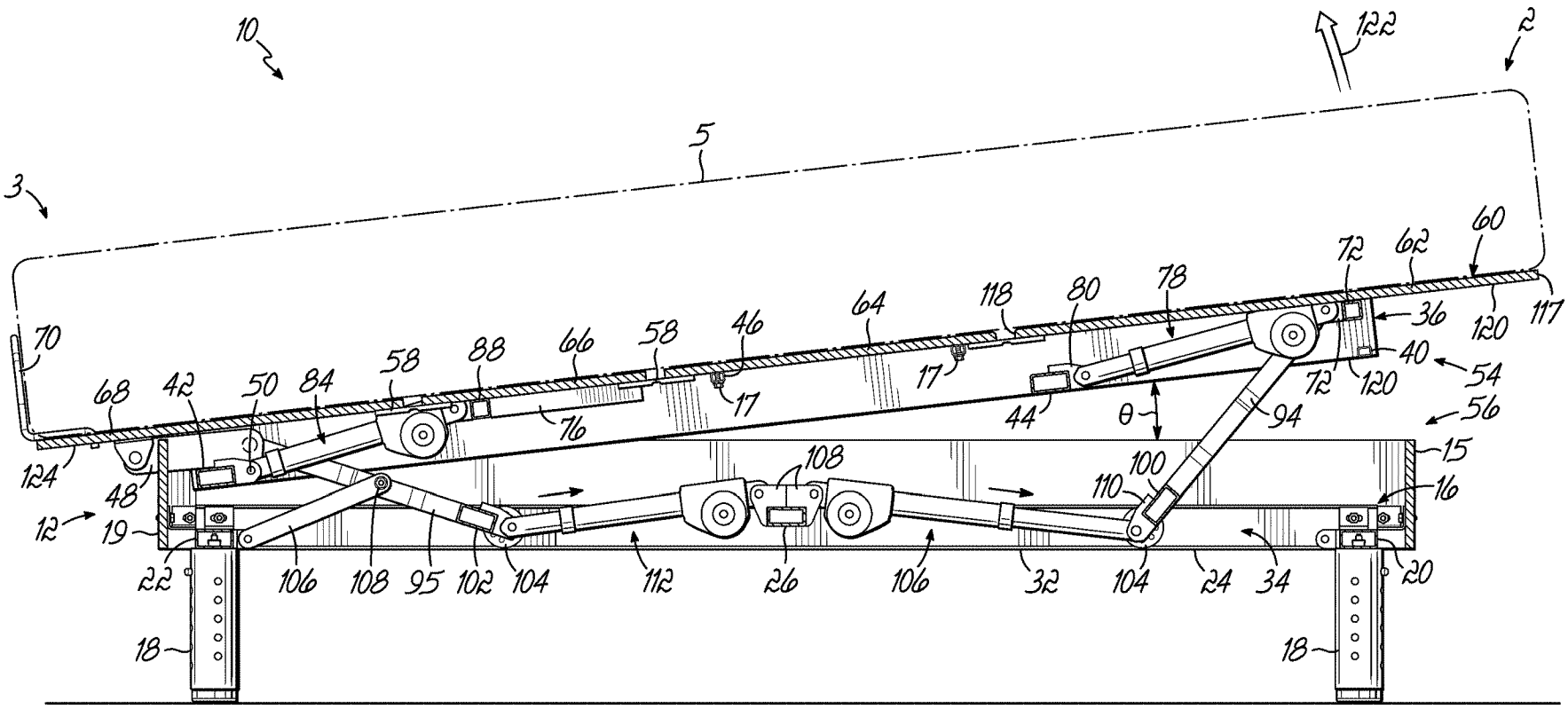
FIG. 6C is a longitudinal cross-sectional view of the adjustable bed base in a downward tilted position with the deck members co-planar.

FIG. 6C illustrates the deck 60 in a flat position with the deck boards being co-planar. However, the deck 60 is in a first tilted position with the head deck board 62 being above the foot deck board 68. More particularly, a front edge 117 of the head deck board 62 is above a rear edge 118 of the head deck board 62. The same is true for each of the deck boards. In the industry this is known as a Reverse Trendelenburg position. When the adjustable bed base 12 is in this position shown in FIG. 6C, the subframe 36 and each of the deck boards is inclined at an angle θ which may be up to six degrees relative to horizontal. In this inclined position shown in FIG. 6C, the front primary lift actuator 106 is fully extended while the rear primary lift actuator 112 remains retracted. As seen in FIG. 6C, when the front primary lift actuator 106 is extending while the rear primary lift actuator 112 remains still or is being retracted, a front portion 120 of the subframe 36 raises upwardly as shown by arrow 122. Alternatively, as shown in FIG. 6D, when the front primary lift actuator 106 remains still or is being retracted while the rear primary lift actuator 112 is being extended, the rear portion 124 of the subframe 36 raises upwardly as shown by arrow 126.

Figure 6D:
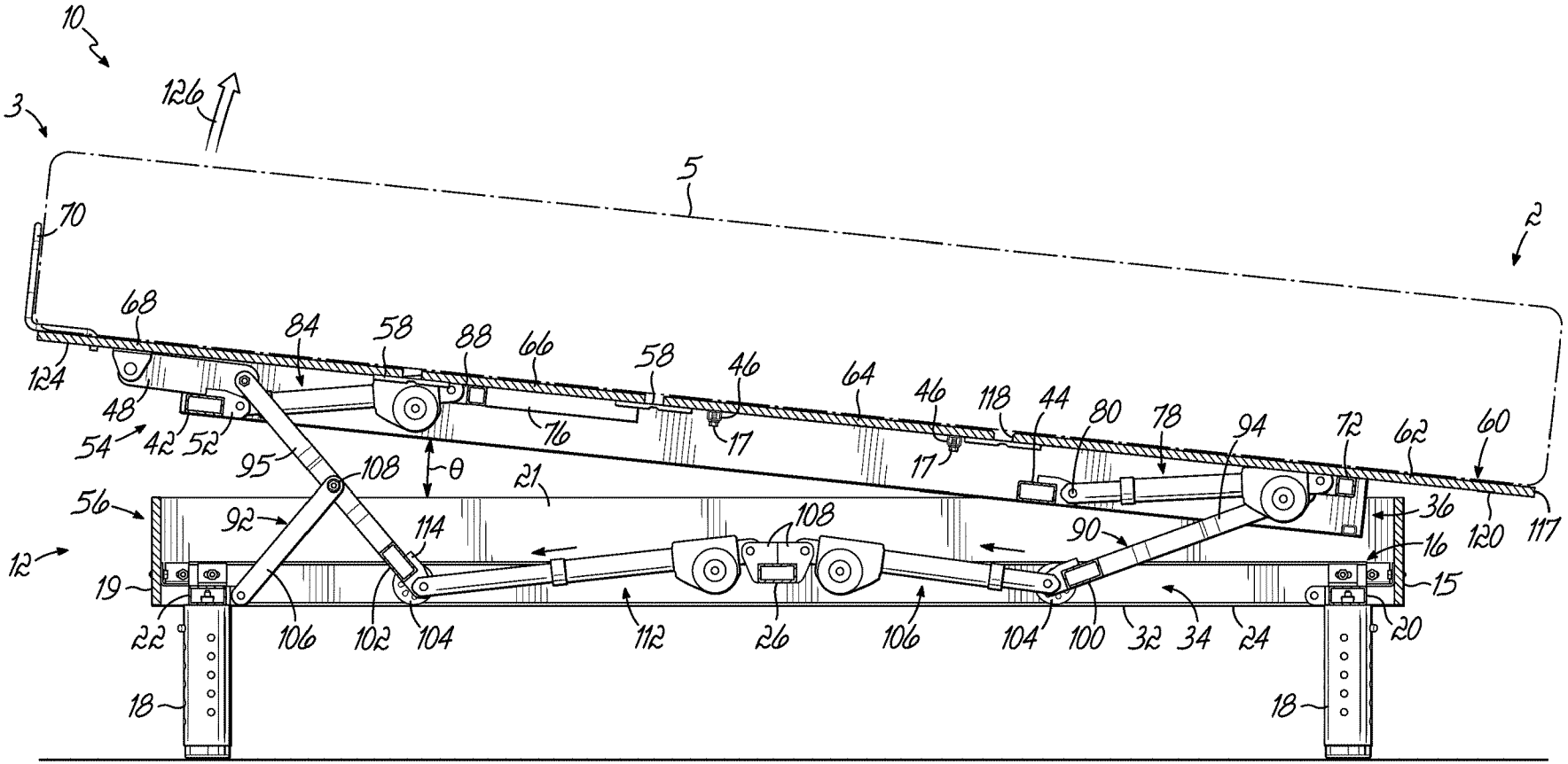
FIG. 6D is a longitudinal cross-sectional view of the adjustable bed base in an upward tilted position with the deck members co-planar.

FIG. 6D illustrates the deck 60 in a flat position with the deck boards being co-planar. However, the deck 60 is in a second tilted position with the foot deck board 68 being above the head deck board 62. More particularly, the front edge 116 of the head deck board 62 is below the rear edge 118 of the head deck board 62. The same is true for each of the deck boards. In the industry this is known as a Trendelenburg position. When the adjustable bed base 12 is in this position shown in FIG. 6D, the subframe 36 and each of the deck boards are declined at an angle θ which may be up to six degrees relative to horizontal.

In each of the positions shown in FIGS. 6A-6D, the front and rear secondary linear actuators 78, 84, respectively, are in their retracted position and are not activated, thereby resulting in a flat deck 60. However, the flat deck 60 may be inclined as shown in FIG. 6C or declined as shown in FIG. 6D.

FIGS. 7A-7D correspond to FIGS. 6A-6D with the subframe in the same respective positions. However, the deck 60 is shown in FIGS. 7A-7D fully inclined or articulated. In other words, the front and rear secondary linear actuators 78, 84, respectively, are fully extended in FIGS. 7A-7D. However, the front and rear primary lift actuators 106, 112, respectively, are fully retracted and not activated.

Figure 7A:
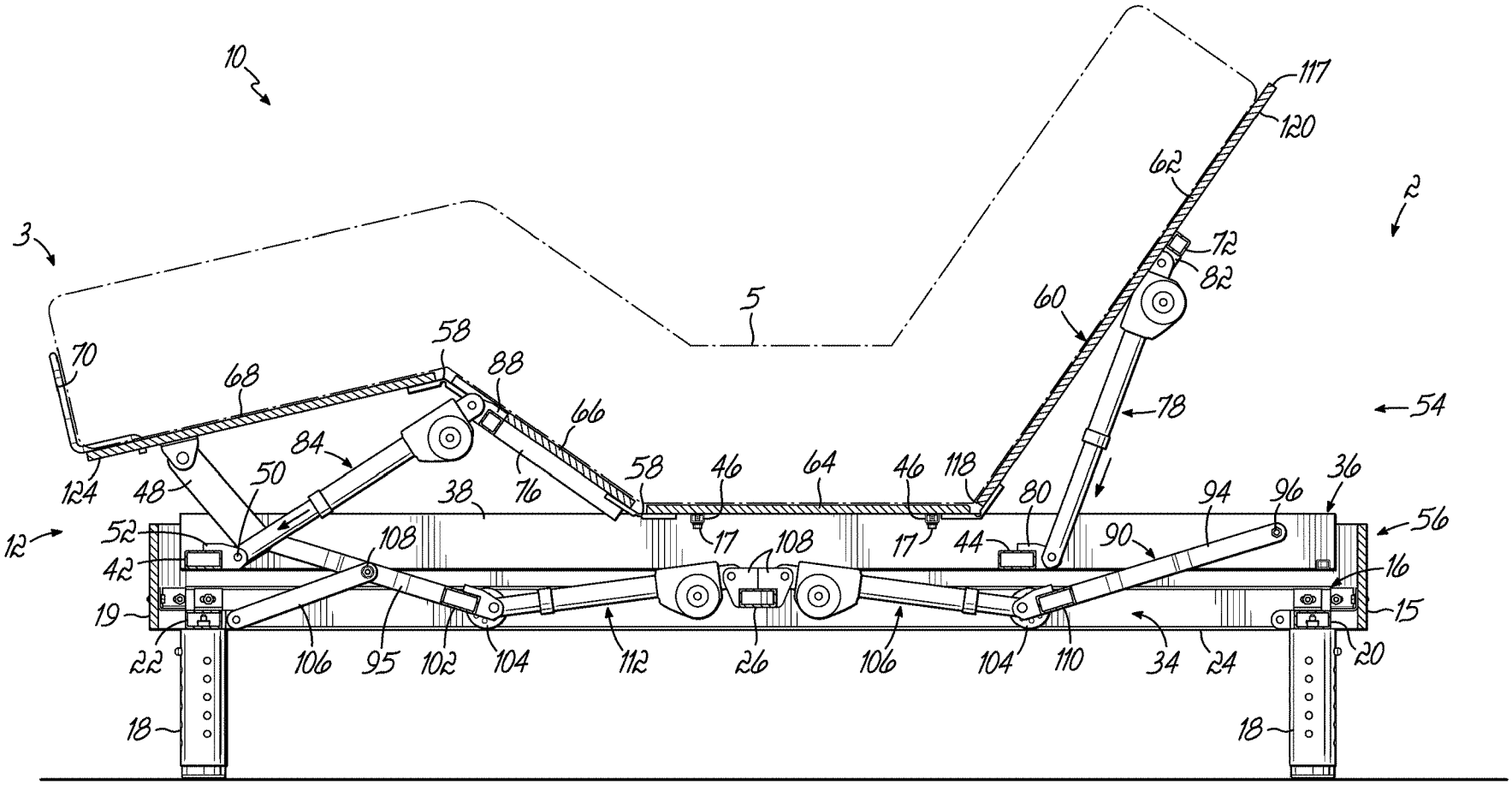
FIG. 7A is a longitudinal cross-sectional view of the adjustable bed base showing the subframe in a lowered position and the deck members fully inclined.
Figure 7B:
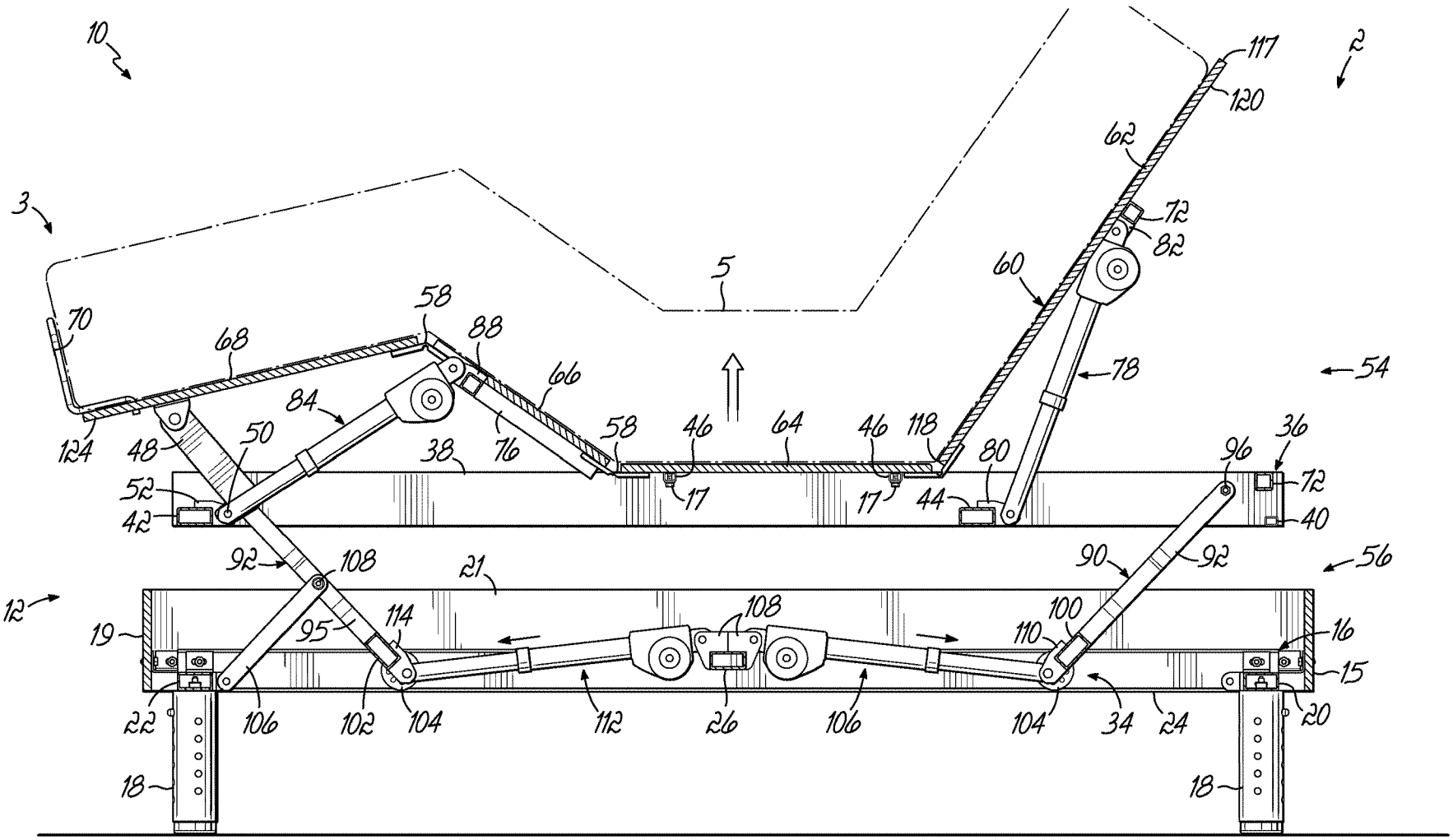
FIG. 7B is a longitudinal cross-sectional view of the adjustable bed base showing the subframe in a raised position and the deck members fully inclined.

FIG. 7A shows the adjustable bed base 12 in a home position with the subframe 36 is its lowered position like FIG. 6A. In this home position, the front and rear primary lift actuators 106, 112, respectively, are fully retracted. From this home position shown in FIG. 7A, the primary linear actuators 106, 112 of adjustable bed base 12 are activated via remote control (not shown) to expand or lengthen. Such expansion of the primary linear actuators 106, 112 shown by arrows 116 in FIG. 7B, causes movement of the wheels 104 in channels 34 outwardly or away from each other. This movement of the wheels 104 causes the front pusher assembly 90 to move forwardly, thereby raising the front lift arms 94 to their fully inclined positions shown in FIG. 7B. This movement of the wheels 104 further causes the rear pusher assembly 92 to move rearwardly, thereby raising the rear lift arms 95 to their fully inclined positions shown in FIG. 7B. FIG. 7B shows the subframe 36 in a fully raised position due to full extension of the front and rear primary lift actuators 106, 112, respectively. FIG. 7B further shows the head, leg and foot deck members 62, 66 and 68 in a fully inclined position due to full extension of the front and rear secondary lift actuators 78, 84, respectively.

Figure 7C:
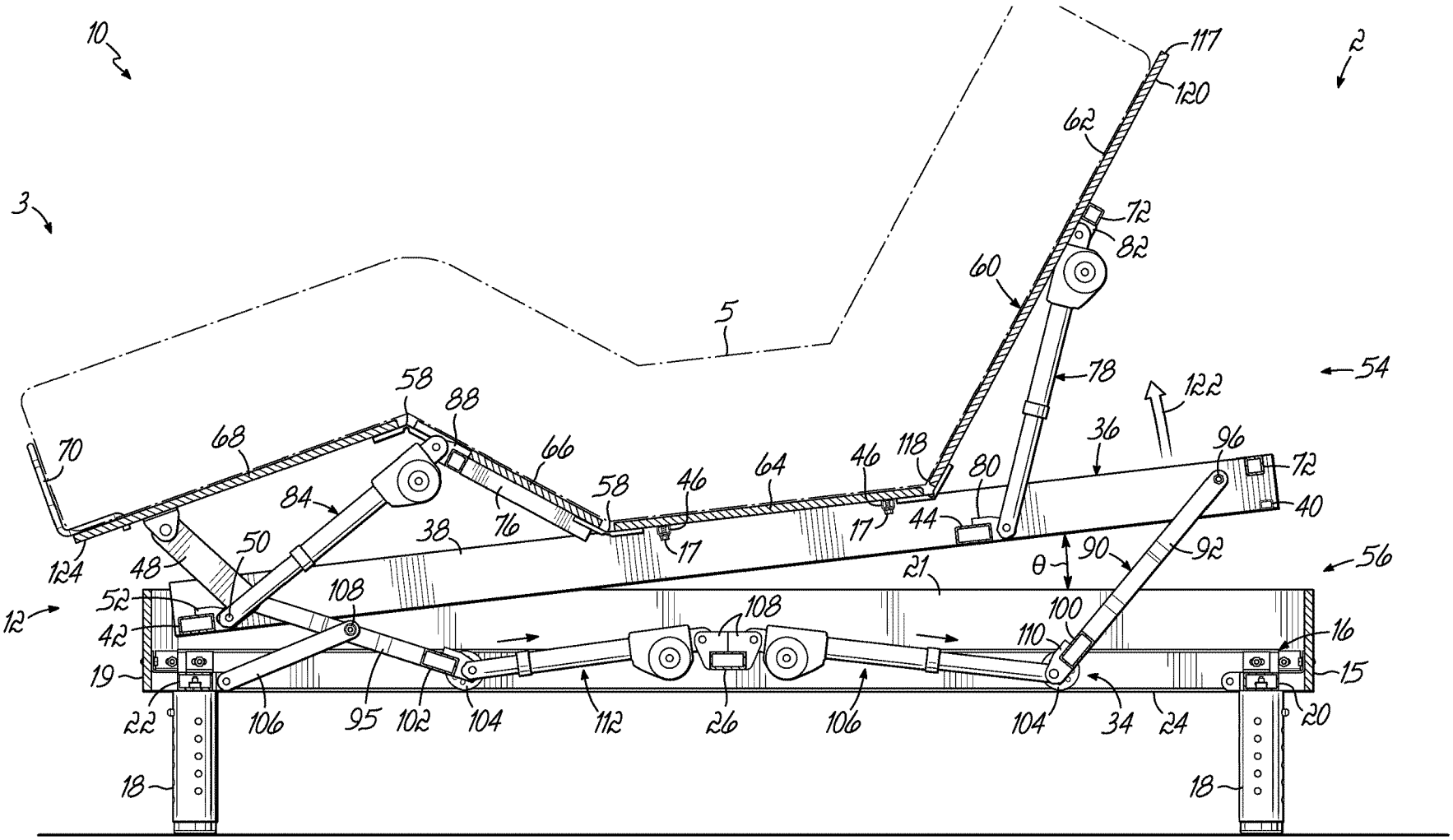
FIG. 7C is a longitudinal cross-sectional view of the adjustable bed base in a downward tilted position with the deck members fully inclined.

FIG. 7C illustrates the articulated deck 60 in a fully inclined position with the head, leg and foot deck boards 62, 66, 68 being fully inclined due to full extension of the front and rear secondary lift actuators 78, 84, respectively. However, the articulated deck 60 is in a first tilted position with the head deck board 62 being above the foot deck board 68. More particularly, a front edge 117 of the head deck board 62 is above a rear edge 118 of the head deck board 62. In the industry this is known as a Reverse Trendelenburg position. When the adjustable bed base 12 is in the position shown in FIG. 7C, the subframe 36 is tilted. In this inclined position shown in FIG. 7C, the front primary lift actuator 106 is fully extended while the rear primary lift actuator 112 remains retracted. As seen in FIG. 7C, when the front primary lift actuator 106 is extending while the rear primary lift actuator 112 remains still or is being retracted, a front portion 120 of the subframe 36 raises upwardly as shown by arrow 123 in FIG. 7C. Alternatively, as shown in FIG. 7D, when the front primary lift actuator 106 remains still or is being retracted while the rear primary lift actuator 112 is being extended, the rear portion 124 of the subframe 36 raises upwardly as shown by arrow 127.

Figure 7D:
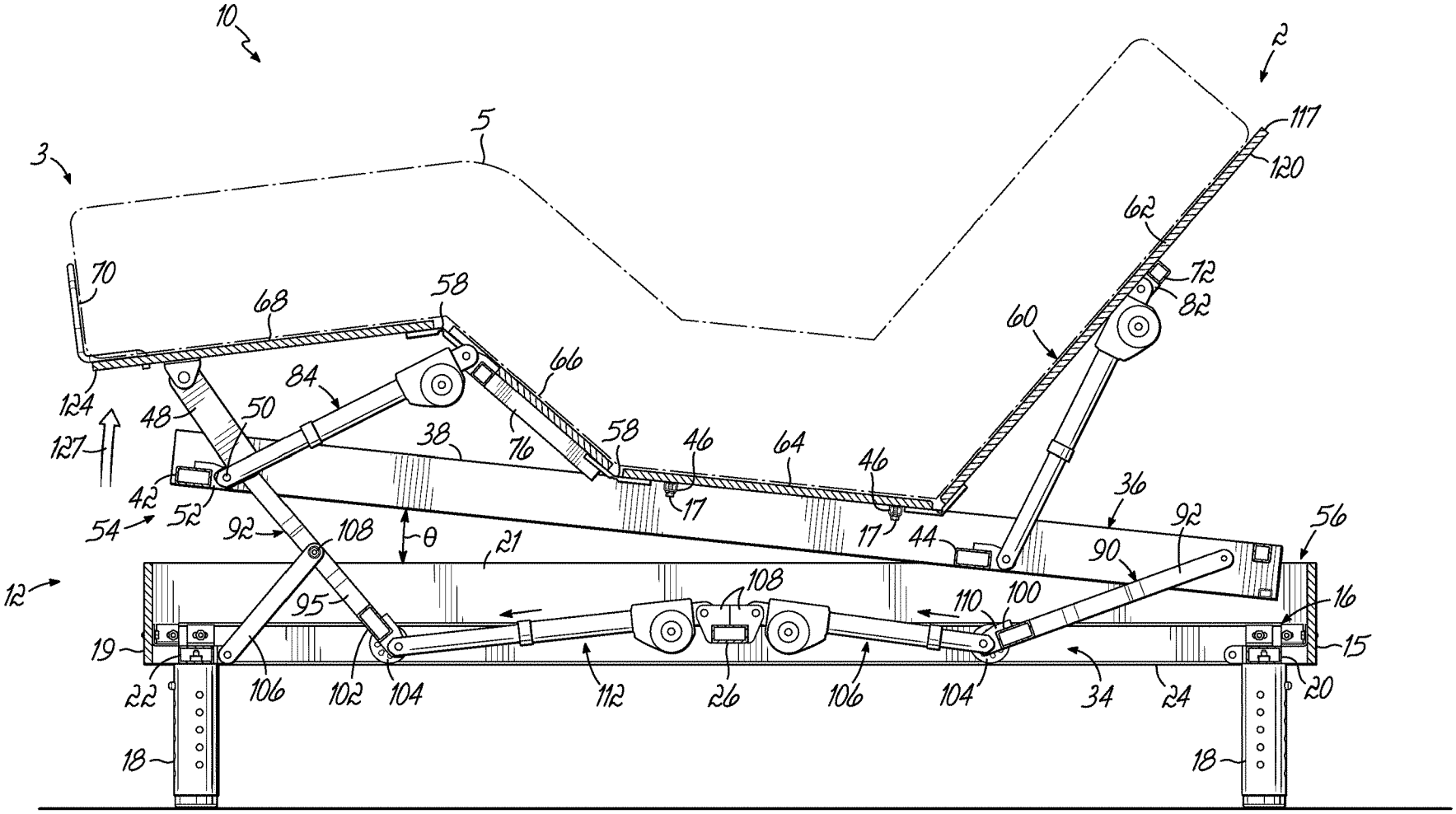
FIG. 7D is a longitudinal cross-sectional view of the adjustable bed base in an upward tilted position with the deck members fully inclined.

FIG. 7D illustrates the articulated deck 60 in its fully inclined position with the deck boards being fully inclined due to full extension of the secondary linear actuators 78, 84. However, the articulated deck 60 is in a second tilted position with the front member 40 of the subframe 36 being above the rear member 42 of the subframe 36. In the industry this is known as a Trendelenburg position. When the adjustable bed base 12 is in this position shown in FIG. 7D, subframe 36 is declined at an angle θ which may be up to six degrees relative to horizontal.

Regardless of the positions of the deck members due to the operation of the secondary linear actuators 78, 84, when the subframe is in its tilted position shown in FIGS. 6C and 7C, the front portion 120 of the subframe 36 is above the rear portion 124 of the subframe 36 with the front member 40 of the subframe 36 being above the rear member 42 of the subframe 36. Conversely, when the subframe is in its tilted position shown in FIGS. 6D and 7D, the front portion 120 of the subframe 36 is below the rear portion 124 of the subframe 36 with the front member 40 of the subframe 36 being below the rear member 42 of the subframe 36.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. An adjustable bed base comprising:

a generally rectangular stationary frame having opposed side rails, a head rail, a foot rail and a middle rail, each of the side rails having a C-shaped cross-section defining a channel;

a subframe secured to the stationary frame, the subframe having opposed side members, a head member, a foot member and a cross member extending between the opposed side members;

front and rear lift arms pivotally secured to the side members of the subframe, the front lift arms being connected by a front push member and the rear lift arms being connected by a rear push member;

rotatable wheels secured to ends of the front and rear lift arms, the rotatable wheels being sized and adapted to move inside the channels of the side rails of the stationary frame;

rear lift arm supports for limiting movement of the rear lift arms, the rear lift arm supports being pivotally secured to the rear lift arms and pivotally secured to corner brackets secured to the stationary frame;

an articulated deck comprising a head deck board, a seat deck board, a leg deck board and a foot deck board hinged together, the seat deck board being secured to the subframe;

a head brace secured to the head deck board;

a leg brace secured to the leg deck board;

a front primary linear actuator for raising and lowering a front portion of the subframe, the front primary linear actuator having a first end pivotally secured to a first mounting bracket secured to the middle rail of the stationary frame and a second end pivotally secured to a mounting bracket secured to the front push member;

a rear primary linear actuator for raising and lowering a rear portion of the subframe, the rear primary linear actuator having a first end pivotally secured to a second mounting bracket secured to the middle rail of the stationary frame and a second end secured to a mounting bracket secured to the rear push member;

a front secondary linear actuator for inclining the head deck board, the front secondary linear actuator having a first end pivotally secured to a mounting bracket secured to the cross member of the subframe and a second end pivotally secured to the head brace;

a rear secondary linear actuator for inclining the leg and foot deck boards, the rear secondary linear actuator having a first end pivotally secured to a mounting bracket secured to the rear member of the subframe and a second end pivotally secured to the leg brace;

legs secured to the stationary frame for supporting the stationary frame.

2. The adjustable bed base of claim 1, further comprising foot links extending between the foot member of the subframe and brackets secured to the foot deck board.

3. The adjustable bed base of claim 1, wherein the head and leg braces are generally U-shaped.

4. The adjustable bed base of claim 1, wherein the linear actuators are motorized.

5. The adjustable bed base of claim 1, wherein the corner brackets secured to the stationary frame are located at corners of the stationary frame.

6. The adjustable bed base of claim 1, wherein the articulated deck is tilted when only one of the front and rear primary linear actuators is fully extended and the other primary linear actuator is not fully extended.

7. The adjustable bed base of claim 1, wherein the articulated deck is horizontal when the front and rear primary linear actuators are fully extended.

8. An adjustable bed base comprising:

a generally rectangular stationary frame having opposed side rails, a head rail, a foot rail and a middle rail, each of the side rails having a C-shaped cross-section defining a channel;

a subframe secured to the stationary frame, the subframe having opposed side members, a head member, a foot member and a cross member extending between the opposed side members, a front pusher assembly comprising front lift arms and a front push member extending between the front lift arms, each of the front lift arms being pivotally secured to one of the side members of the subframe;

a rear pusher assembly comprising rear lift arms and a rear push member extending between the rear lift arms, each of the rear lift arms being pivotally secured to one of the side members of the subframe;

rotatable wheels secured to lower ends of the front and rear lift arms, the rotatable wheels being movable inside the channels of the side rails of the stationary frame;

lift arm supports for limiting movement of one of the front and rear lift arms, each of the lift arm supports being pivotally secured to one of the lift arms and pivotally secured to a corner bracket secured to the stationary frame;

an articulated deck comprising a head deck board, a seat deck board, a leg deck board and a foot deck board hinged together, the seat deck board being secured to the subframe;

a head brace secured to the head deck board;

a leg brace secured to the leg deck board;

a front primary linear actuator having a first end pivotally secured to a first mounting bracket secured to the middle rail of the stationary frame and a second end pivotally secured to a mounting bracket secured to the front pusher assembly, wherein the front pusher assembly is moved forwardly when the front primary linear actuator is extended, thereby raising a front portion of the subframe;

a rear primary linear actuator having a first end pivotally secured to a second mounting bracket secured to the middle rail of the stationary frame and a second end secured to a mounting bracket secured to the rear pusher assembly, wherein the rear primary linear actuator moves the rear pusher assembly rearwardly when the rear primary linear actuator is extended, thereby raising a rear portion of the subframe;

a front secondary linear actuator for inclining the head deck board, the front secondary linear actuator having a first end pivotally secured to a mounting bracket secured to the cross member of the subframe and a second end pivotally secured to the head brace; and a rear secondary linear actuator for moving the leg and foot deck boards, the rear secondary linear actuator having a first end pivotally secured to a mounting bracket secured to the rear member of the subframe and a second end pivotally secured to the leg brace.

9. The adjustable bed base of claim 8, further comprising legs secured to the stationary frame for supporting the stationary frame.

10. The adjustable bed base of claim 9, wherein the linear actuators are motorized.

11. The adjustable bed base of claim 8, wherein the head and leg braces are generally U-shaped.

12. The adjustable bed base of claim 8, wherein the adjustable bed base has two front lift arms and two rear lift arms.

13. The adjustable bed base of claim 8, wherein the further the front and rear push members are separated, the higher the articulated deck.

14. The adjustable bed base of claim 8, wherein the articulated deck is tilted when one of the primary linear actuators is extended more than the other primary linear actuator.

15. The adjustable bed base of claim 8, wherein the subframe is raised above the stationary frame when the primary linear actuators are extended.

16. An adjustable bed base comprising:

a stationary frame having opposed side rails, a head rail, a foot rail and a middle rail, each of the side rails having a C-shaped cross-section defining a channel;

a subframe having opposed side members, a head member, a foot member and a cross member extending between the opposed side members, front and rear lift arms, each of the front and rear lift arms being pivotally secured to one of the side members of the subframe, a front push member extending between the front lift arms;

a rear push member extending between the rear lift arms;

rotatable wheels secured to the front and rear lift arms, the rotatable wheels being movable inside the channels of the side rails of the stationary frame;

lift arm supports for limiting movement of the two of the lift arms;

an articulated deck comprising a head deck board, a seat deck board, a leg deck board and a foot deck board hinged together, the seat deck board being secured to the subframe;

a head brace secured to the head deck board;

a leg brace secured to the leg deck board;

a front primary motorized linear actuator for moving the front push member forwardly, thereby raising and lowering a front portion of the subframe, the front primary motorized linear actuator having a first end pivotally secured to a first mounting bracket secured to the middle rail of the stationary frame and a second end pivotally secured to a mounting bracket secured to the front push member;

a rear primary motorized linear actuator for moving the rear push member rearwardly, thereby raising and lowering a rear portion of the subframe, the rear primary motorized linear actuator having a first end pivotally secured to a second mounting bracket secured to the middle rail of the stationary frame and a second end secured to a mounting bracket secured to the rear push member;

a front secondary motorized linear actuator for inclining the head deck board, the front secondary motorized linear actuator having a first end pivotally secured to a mounting bracket secured to the cross member of the subframe and a second end pivotally secured to the head brace; and a rear secondary motorized linear actuator for moving the leg and foot deck boards, the rear secondary motorized linear actuator having a first end pivotally secured to a mounting bracket secured to the rear member of the subframe and a second end pivotally secured to the leg brace.

17. The adjustable bed base of claim 16, wherein each of the lift arm supports is pivotally secured to one of the front lift arms and pivotally secured to a corner bracket secured to the stationary frame.

18. The adjustable bed base of claim 16, wherein each of the lift arm supports is pivotally secured to one of the rear lift arms and pivotally secured to a corner bracket secured to the stationary frame.

19. The adjustable bed base of claim 16, further comprising legs secured to the stationary frame for supporting the stationary frame.

20. The adjustable bed base of claim 16, wherein the articulated deck is tilted when one of the primary motorized linear actuators is extended more than the other primary motorized linear actuator.

* * * * *